US012745841B2

(12) United States Patent
Chen et al.

(10) Patent No.: US 12,745,841 B2
(45) Date of Patent: Sep. 29, 2026

(54) ADJUSTING DEVICE AND RELATED SLIDE RAIL MECHANISM

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shih-Lung Huang, Kaohsiung City (TW); Yi-Syuan Jhao, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 143 days.

(21) Appl. No.: 18/908,741

(22) Filed: Oct. 7, 2024

(65) Prior Publication Data

US 2025/0338960 A1 Nov. 6, 2025

(30) Foreign Application Priority Data

May 6, 2024 (TW) ..... 113116827

(51) Int. Cl.
*A47B 88/00* (2017.01)
*A47B 88/407* (2017.01)
*A47B 88/453* (2017.01)

(52) U.S. Cl.
CPC ..... *A47B 88/453* (2017.01); *A47B 88/407* (2017.01)

(58) Field of Classification Search
CPC ..... A47B 57/585; A47B 2210/0018; A47B 2210/0007; A47B 2210/0086; A47B 2097/008; A47B 88/50; A47B 88/49; A47B 88/40; A47B 88/45; A47B 88/467; A47B 88/57; A47B 88/447; A47B 67/04;
(Continued)

(56) References Cited

U.S. PATENT DOCUMENTS 4,478,446 A 10/1984 Duran
4,772,078 A * 9/1988 Bowyer ..... E05B 65/464 312/220
(Continued)

FOREIGN PATENT DOCUMENTS

CA 2992608 A1 * 3/2019 ..... A47B 88/497
CN 115104867 A * 9/2022 ..... A47B 88/49
(Continued)

*Primary Examiner* — Janet M Wilkens
(74) *Attorney, Agent, or Firm* — Winston Hsu

(57) ABSTRACT

An adjusting device is provided and includes a base, a driving member, an adjusting member and an engaging member. The adjusting member is arranged on the base and adjustably connected to the driving member. The engaging member is switchable between an engaging state and a disengaging state relative to the base. When the engaging member is in the engaging state, the engaging member is configured to engage with the adjusting member for preventing the adjusting member from adjusting the driving member. When the engaging member is in the disengaging state, the engaging member disengages from the adjusting member for allowing the adjusting member to adjust the driving member.

18 Claims, 11 Drawing Sheets

(58) Field of Classification Search
CPC ..... A47B 97/00; E05B 65/464; E05B 65/463; E05B 65/465; E05B 65/462; E05B 63/0056
USPC ..... 312/319.8, 319.1, 220, 216, 217, 221; 70/85–87, DIG. 8; 292/2, 27, 46, 47, 49, 292/117, 215, 338; 211/26
See application file for complete search history.

(56) References Cited

U.S. PATENT DOCUMENTS

| | | | | |
|---|---|---|---|---|
| 8,540,328 | B2 * | 9/2013 | Chen | A47B 88/57 312/333 |
| 2024/0268555 | A1 * | 8/2024 | Chen | A47B 88/45 |
| 2024/0309681 | A1 * | 9/2024 | Chen | A47B 88/447 |
| 2025/0072604 | A1 * | 3/2025 | Lin | E05B 65/464 |

FOREIGN PATENT DOCUMENTS

| | | | | | |
|---|---|---|---|---|---|
| CN | 217510123 | U | | 9/2022 | |
| CN | 218074140 | U | * | 12/2022 | |
| CN | 218390326 | U | * | 1/2023 | |
| CN | 116831400 | A | * | 10/2023 | A47B 88/50 |
| CN | 220192543 | U | * | 12/2023 | |
| CN | 220889859 | U | * | 5/2024 | E05B 65/464 |
| CN | 118415458 | A | * | 8/2024 | E05B 65/463 |
| CN | 118686499 | A | * | 9/2024 | A47B 67/04 |
| DE | 202004001998 | U1 | * | 5/2004 | A47B 88/57 |
| EP | 3 064 680 | A1 | | 9/2016 | |
| EP | 4517032 | A1 | * | 3/2025 | E05B 65/464 |
| GB | 2 049 789 | A | | 12/1980 | |
| TW | I822613 | B | | 11/2023 | |
| WO | WO-2023198149 | A1 | * | 10/2023 | A47B 88/467 |

* cited by examiner

ADJUSTING DEVICE AND RELATED SLIDE RAIL MECHANISM

BACKGROUND OF THE INVENTION

1. Field of the Invention

The present invention relates to an adjusting device, and more specifically, to an adjusting device with a protective function and a related slide rail mechanism.

2. Description of the Prior Art

Taiwan Patent No. 1822613 discloses an adjusting device of a slide rail mechanism. The adjusting device includes a base, a driving member and an adjusting member. The adjusting member is arranged on the base and configured to adjust the driving member. The adjusting device is configured to cooperate with a working member, so as to function as an interlock for allowing only one slide rail assembly of the slide rail mechanism to be opened.

However, no protective mechanism is provided for the interlock. In other words, when an external force is applied onto the adjusting member unintentionally, the driving member and/or the working member may be driven to cause malfunction of the interlock. Therefore, in order to meet different requirements, it becomes an important topic to provide a different product.

SUMMARY OF THE INVENTION

It is an objective of the present invention to provide an adjusting device with a protective function, and a related slide rail mechanism.

According to an aspect of the present invention, an adjusting device includes a base, a driving member, an adjusting member and an engaging member. The adjusting member is arranged on the base and adjustably connected to the driving member. The engaging member is switchable between an engaging state and a disengaging state relative to the base. When the engaging member is in the engaging state, the engaging member is configured to engage with the adjusting member for preventing the adjusting member from adjusting the driving member. When the engaging member is in the disengaging state, the engaging member disengages from the adjusting member for allowing the adjusting member to adjust the driving member.

According to another aspect of the present invention, a slide rail mechanism includes a first slide rail assembly, a second slide rail assembly, an adjusting device, an auxiliary device and a working member. The first slide rail assembly includes a first rail and a second rail displaceable relative to the first rail along a longitudinal direction. The second slide rail assembly includes a third rail and a fourth rail displaceable relative to the third rail along the longitudinal direction. The adjusting device is movably mounted on the first slide rail assembly. The auxiliary device is movably mounted on the second slide rail assembly. The working member is arranged between the adjusting device and the auxiliary device. When the second rail displaces relative to the first rail along an opening direction, the adjusting device, the working member and the auxiliary device are driven to move, such that the auxiliary device prevents the fourth rail from displacing relative to the third rail along the opening direction. The adjusting device includes a base, an adjusting member and an engaging member. The adjusting member is arranged on the base and configured to adjust the working member, and the engaging member is switchable between an engaging state and a disengaging state relative to the base. When the engaging member is in the engaging state, the engaging member is configured to engage with the adjusting member for preventing the adjusting member from adjusting the driving member. When the engaging member is in the disengaging state, the engaging member disengages from the adjusting member for allowing the adjusting member to adjust the driving member.

It is another objective of the present invention to provide an adjusting device capable of compensating assembly error.

According to another aspect of the present invention, an adjusting device is adapted for a working member. The adjusting device includes a base, a driving member and an adjusting member. The adjusting member is arranged on the base and adjustably connected to the driving member. The base of the adjusting device includes a receiving structure configured to at least partially receive the driving member and the adjusting member. The working member is driven to move in response to a movement of the driving member. The working member includes a first end portion inserted into a first receiving portion of the receiving structure of the base of the adjusting device along a height direction. A dimension of the first receiving portion of the receiving structure of the base of the adjusting device along a longitudinal direction perpendicular to the height direction is greater than a dimension of the first end portion of the working member along the longitudinal direction for allowing the working member to move along the longitudinal direction within a limited range.

In summary, the engaging member is configured to cooperate with the adjusting member to prevent an unintentional movement of the adjusting member, which enhances reliability of the adjusting device. Furthermore, by configuration of that the dimension of the first receiving portion of the receiving structure of the base of the adjusting device along the longitudinal direction is greater than the dimension of the first end portion of the working member along the longitudinal direction for allowing the working member to move along the longitudinal direction within the limited range, the adjusting device can compensate assembly error.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
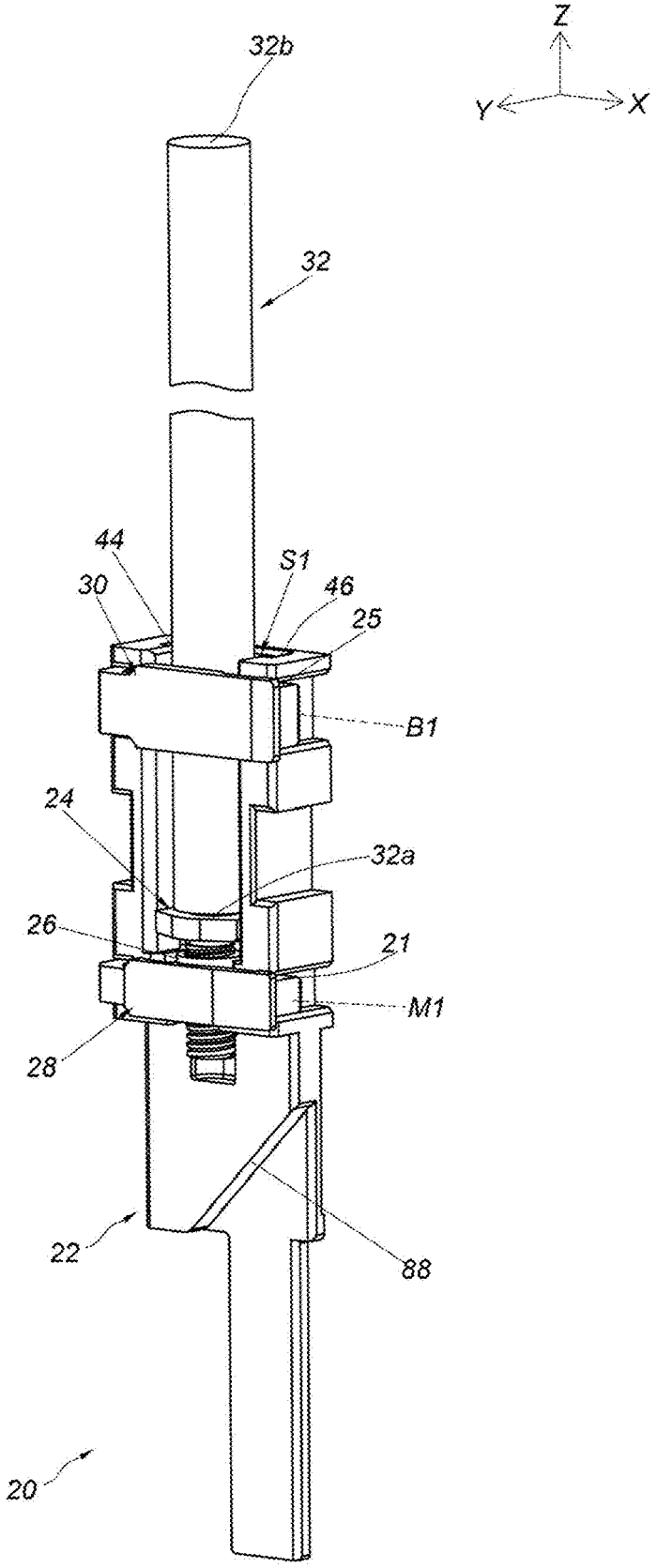
FIG. 1 is a diagram of an adjusting device in a first state according to an embodiment of the present invention.
Figure 2:
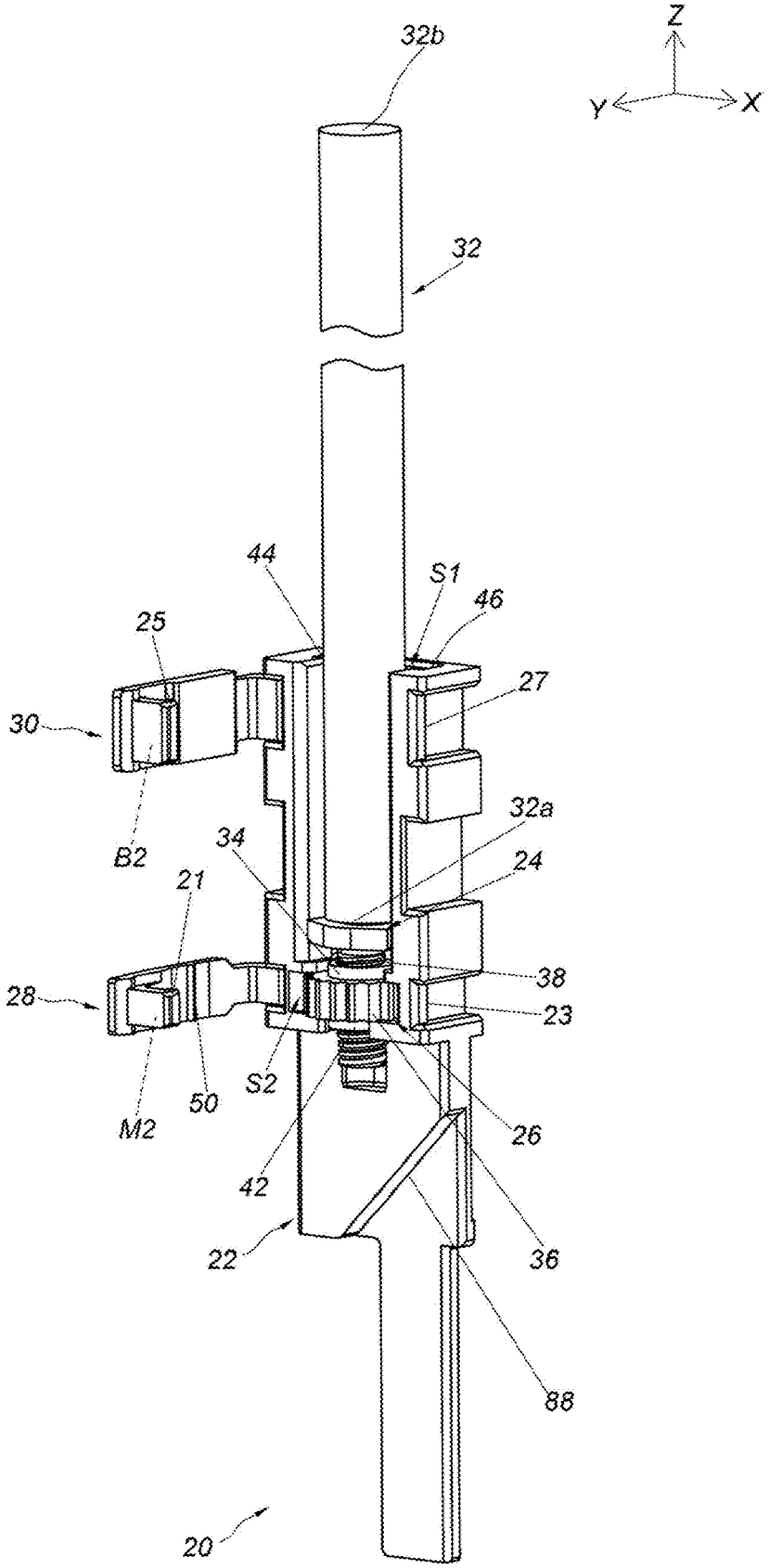
FIG. 2 is a diagram of the adjusting device in a second state according to the embodiment of the present invention.
Figure 3:
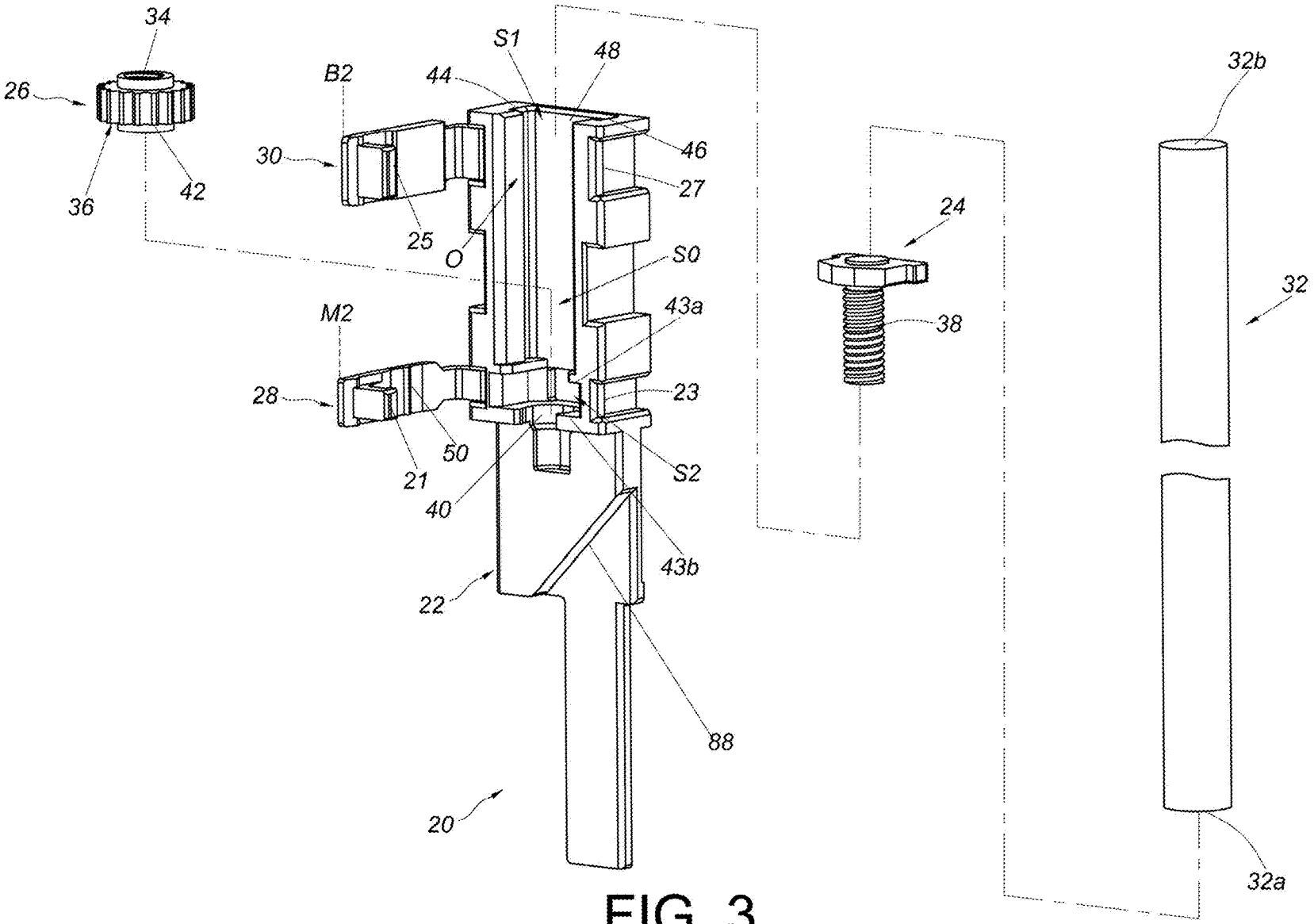
FIG. 3 is an exploded diagram of the adjusting device according to the embodiment of the present invention.

As shown in FIG. 1 to FIG. 3, an adjusting device 20 includes a base 22, a driving member 24 and an adjusting member 26. Preferably, the adjusting device 20 further includes an engaging member 28 and/or a blocking member 30. In this embodiment, by way of example, the adjusting device 20 is configured to cooperate with a working member 32, and the working member 32 is formed in a rod-shaped structure. However, the present invention is not limited to this embodiment. Both the adjusting member 26 and the driving member 24 are arranged on the base 22. The adjusting member 26 is adjustably connected to the driving member 24.

The engaging member 28 is switchable relative to the base 22 between an engaging state M1 and a disengaging state M2. Preferably, the engaging member 28 is movably mounted on the base 22. For example, an end of the engaging member 28 is pivotally connected to the base 22. Furthermore, the blocking member 30 is switchable relative to the base 22 between a blocking state B1 and a non-blocking state B2. Preferably, the blocking member 30 is movably mounted on the base 22. For example, an end of the blocking member 30 is pivotally connected to the base 22. As shown in FIG. 1, when the engaging member 28 and the blocking member 30 are in the engaging state M1 and the blocking state B1, respectively, the engaging member 28 and the blocking member 30 are folded relative to the base 22. As shown in FIG. 2, when the engaging member 28 and the blocking member 30 are in the disengaging state M2 and the non-blocking state B2, respectively, the engaging member 28 and the blocking member 30 are unfolded relative to the base 22.

As shown in FIG. 1, the engaging member 28 is in the engaging state M1 to engage with the adjusting member 26 for preventing the adjusting member 26 from adjusting the driving member 24, e.g., by restraining the adjusting member 26 from being manipulated by a user or from being driven by an external force unintentionally. Preferably, another end of the engaging member 28 includes a first predetermined feature 21, and the base 22 includes a second predetermined feature 23 configured to engage with the first predetermined feature 21. In this embodiment, by way of example, the first predetermined feature 21 and the second predetermined feature 23 are an engaging hook and a wall, respectively. However, the present invention is not limited to this embodiment. When the first predetermined feature 21 and the second predetermined feature 23 engage with each other, the engaging member 28 can be retained in the engaging state M1. Preferably, the engaging member 28 in the engaging state M1 can cover the adjusting member 26 or at least an adjusting portion 36 of the adjusting member 26 for preventing the adjusting member 26 from being manipulated by the user or from being driven by the external force unintentionally.

Similarly, another end of the blocking member 30 includes a first predetermined portion 25, and the base 22 further includes a second predetermined portion 27 configured to engage with the first predetermined portion 25. In this embodiment, by way of example, the first predetermined portion 25 and the second predetermined portion 27 are an engaging hook and a wall, respectively. However, the present invention is not limited to this embodiment. When the first predetermined portion 25 and the second predetermined portion 27 engage with each other, the blocking member 30 can be retained in the blocking state B1.

Preferably, the base 22 includes a receiving structure S0 configured to at least partially receive the driving member 24 and the adjusting member 26. For example, the receiving structure S0 includes a first receiving portion S1 and a second receiving portion S2 communicated with the first receiving portion S1. The first receiving portion S1 is configured to receive the driving member 24 and a portion of the working member 32, e.g., an end portion or a first end portion 32*a* of the working member 32, and the second receiving portion S2 is configured to receive a portion of the adjusting member 26.

It should be noticed that the first end portion 32*a* of the working member 32 is inserted into the first receiving portion S1 of the base 22 along a height direction. In this embodiment, by way of example, the height direction can be parallel to a Z axis. Besides, a longitudinal direction can be parallel to an X axis, and a transverse direction can be parallel to a Y axis. The height direction, the longitudinal direction and the transverse direction are perpendicular to one another.

In this embodiment, by way of example, the first end portion 32*a* of the working member 32 and the driving member 24 are configured to abut against each other. However, the present invention is not limited to this embodiment. For example, in another embodiment, the first end portion 32*a* of the working member 32 and the driving member 24 can be connected, e.g., fixedly connected, to each other or integrally formed with each other.

Preferably, the adjusting member 26 and the driving member 24 are connected to each other in a screwing manner. For example, the adjusting member 26 includes a connecting portion 34 and the adjusting portion 36 arranged on an outer periphery of the connecting portion 34. Furthermore, the driving member 24 includes corresponding portion 38 extending from the first receiving portion S1 to the second receiving portion S2 and configured to be connected to the connecting portion 34 of the adjusting member 26 in a screwing manner. For example, the corresponding portion 38 of the driving member 24 and the connecting portion 34 of the adjusting member 26 have threaded features matching with each other. The adjusting portion 36 of the adjusting member 26 is received inside the second receiving portion S2.

Preferably, the base 22 further includes a mounting portion 40. The adjusting member 26 further includes an extending portion 42 passing through the mounting portion 40. The adjusting portion 36 is located between the extending portion 42 and the connecting portion 34.

Preferably, the base 22 further includes a first restraining section 43*a* and a second restraining g section 43*b*. The second receiving portion S2 is defined between the first restraining section 43*a* and the second restraining section 43*b*. The first restraining section 43*a* and the second restraining section 43*b* are configured to restrict the adjusting portion 36 of the adjusting member 26 within the second receiving portion S2, so as to restrict a movement of the adjusting member 26 along the height direction.

Preferably, the first receiving portion S1 is a channel structure having a predetermined length and defined by a first predetermined wall 44, a second predetermined wall 46 and a middle wall 48 of the base 22 cooperatively. The middle wall 48 of the base 22 is connected to and located between the first predetermined wall 44 and the second predetermined wall 46 of the base 22, and the first predetermined wall 44 and the second predetermined wall 46 of the base 22 are substantially perpendicular to the middle wall 48 of the base 22.

Figure 4:
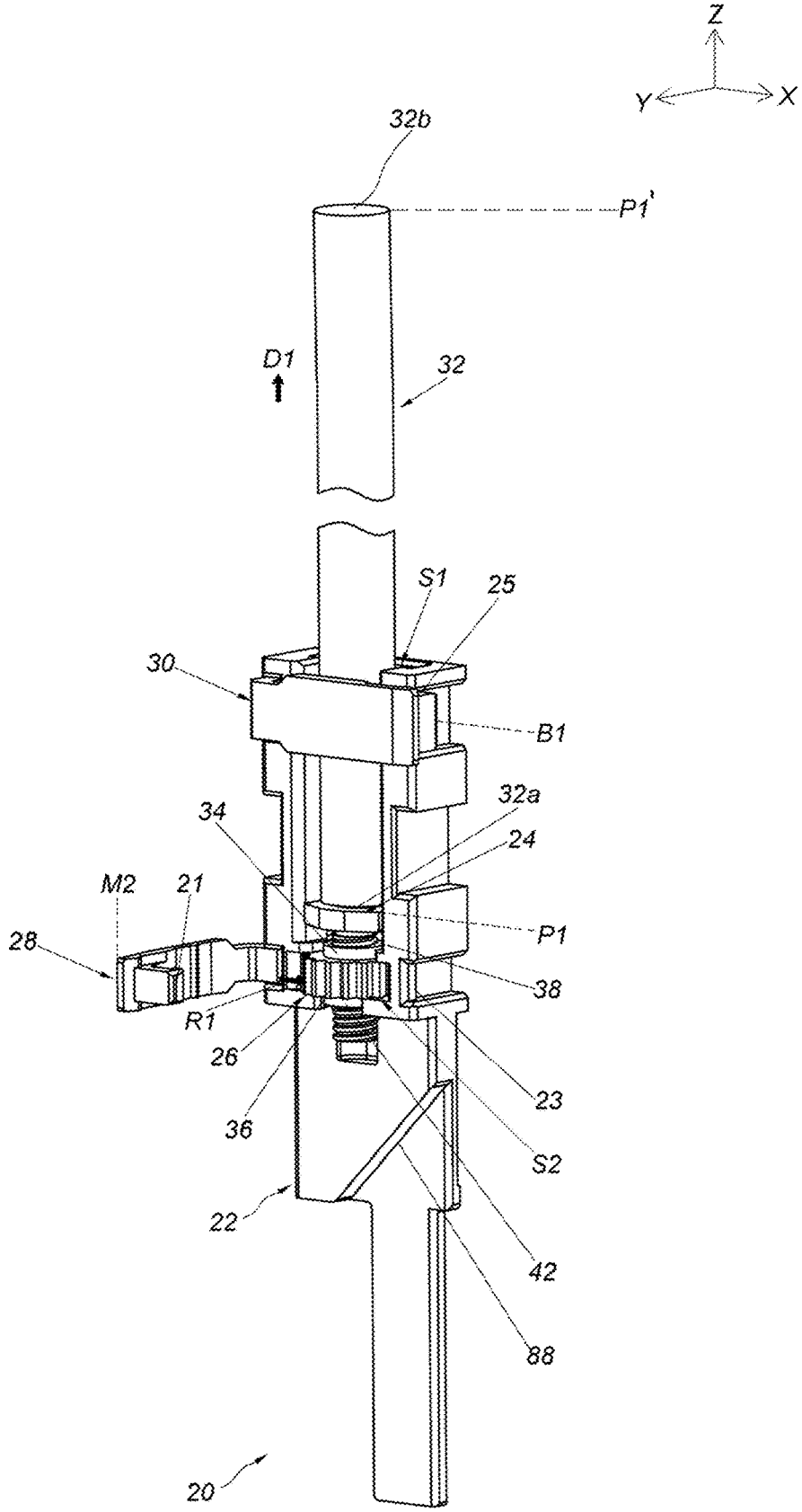
FIG. 4 is a diagram illustrating a working member is adjusted to a first predetermined position by the adjusting device according to the embodiment of the present invention.
Figure 5:
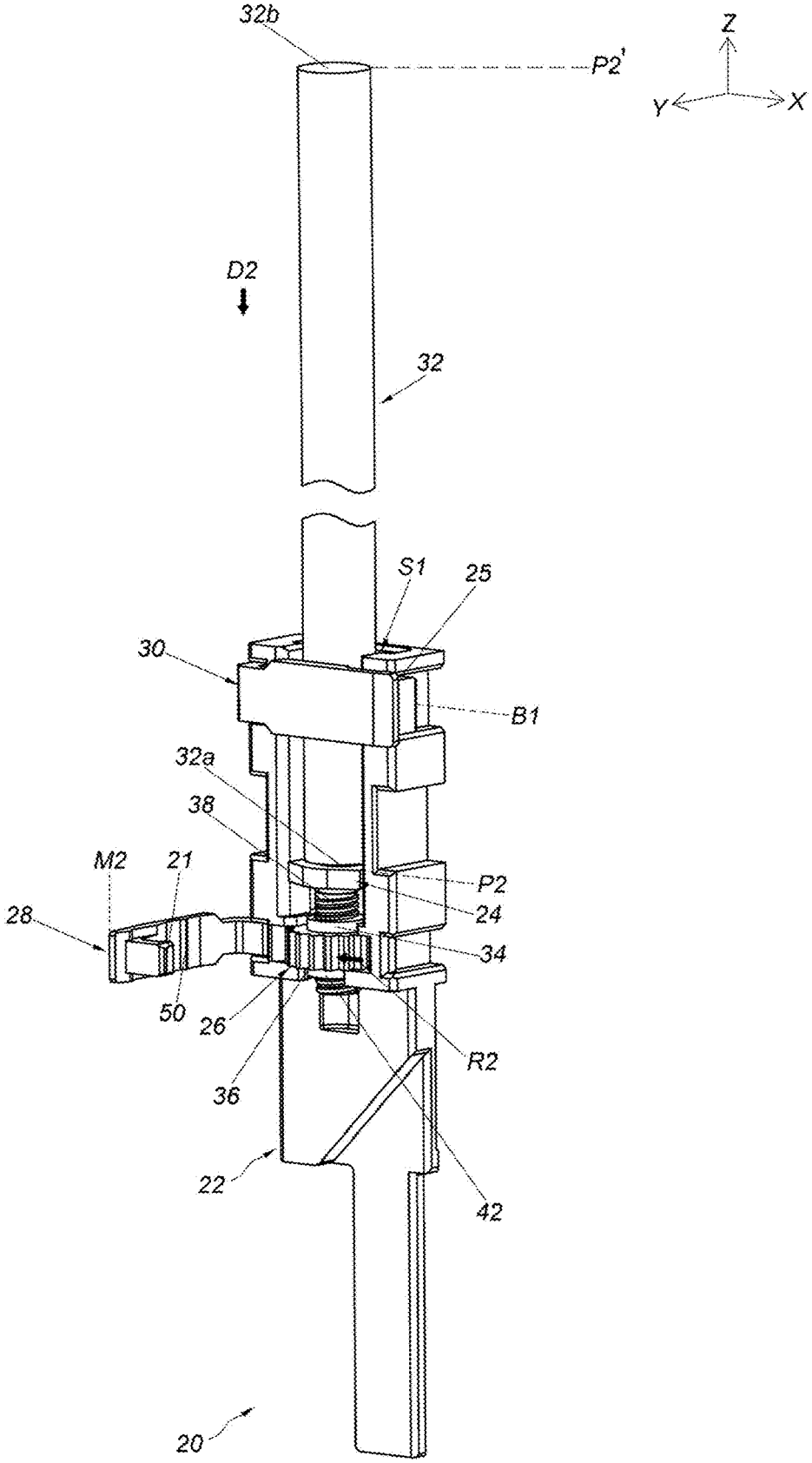
FIG. 5 is a diagram illustrating the working member is adjusted to a second predetermined position by the adjusting device according to the embodiment of the present invention.

As shown in FIG. 4 and FIG. 5, the engaging member 28 is in the disengaging state M2 to disengage from the adjusting member 26 for allowing the adjusting member 26 to adjust the driving member 24, e.g., for allowing the adjusting member 26 to be manipulated by the user to adjust the driving member 24. Preferably, the first receiving portion S1 of the base 22 includes a transversal opening O. When it is desired to adjust the driving member 24 and the working member 32 by manipulating the adjusting member 26, the blocking member 30 can be operated to the blocking state B1 to block the transversal opening O for preventing the working member 32 from departing from the first receiving portion S1 of the base 22 of the adjusting device 20 along the transverse direction parallel to the Y axis via the transversal opening O.

The adjusting member 26 is configured to adjust the driving member 24. For example, the driving member 24 can be adjusted by rotation of the adjusting member 26. Specifically, the user can manipulate the adjusting portion 36 to rotate the adjusting member 26 along a first rotating direction R1 to adjust the driving member 24 to move relative to the base 22 for driving the working member 32 to move in response to a movement of the driving member 24, e.g., to adjust the driving member 24 to move relative to the base 22 from a first predetermined position P1 as shown in FIG. 4 to a second predetermined position P2 as shown in FIG. 5 along a first direction D1 for driving the working member 32 to move from a first corresponding position P1' as shown in FIG. 4 to a second corresponding position P2' as shown in FIG. 5. Alternatively, the user can manipulate the adjusting portion 36 to rotate the adjusting member 26 along a second rotating direction R2 opposite to the first rotating direction R1 to adjust the driving member 24 to move relative to the base 22 from the second predetermined position P2 as shown in FIG. 5 to the first predetermined position P1 as shown in FIG. 4 along a second direction D2 opposite to the first direction D1 for driving the working member 32 to move from the second corresponding position P2' as shown in FIG. 5 to the first corresponding position P1' as shown in FIG. 4.

Preferably, the driving member 24 and the working member 32 are configured to move linearly relative to the base 22 along the height direction parallel to the Z axis.

Figure 6:
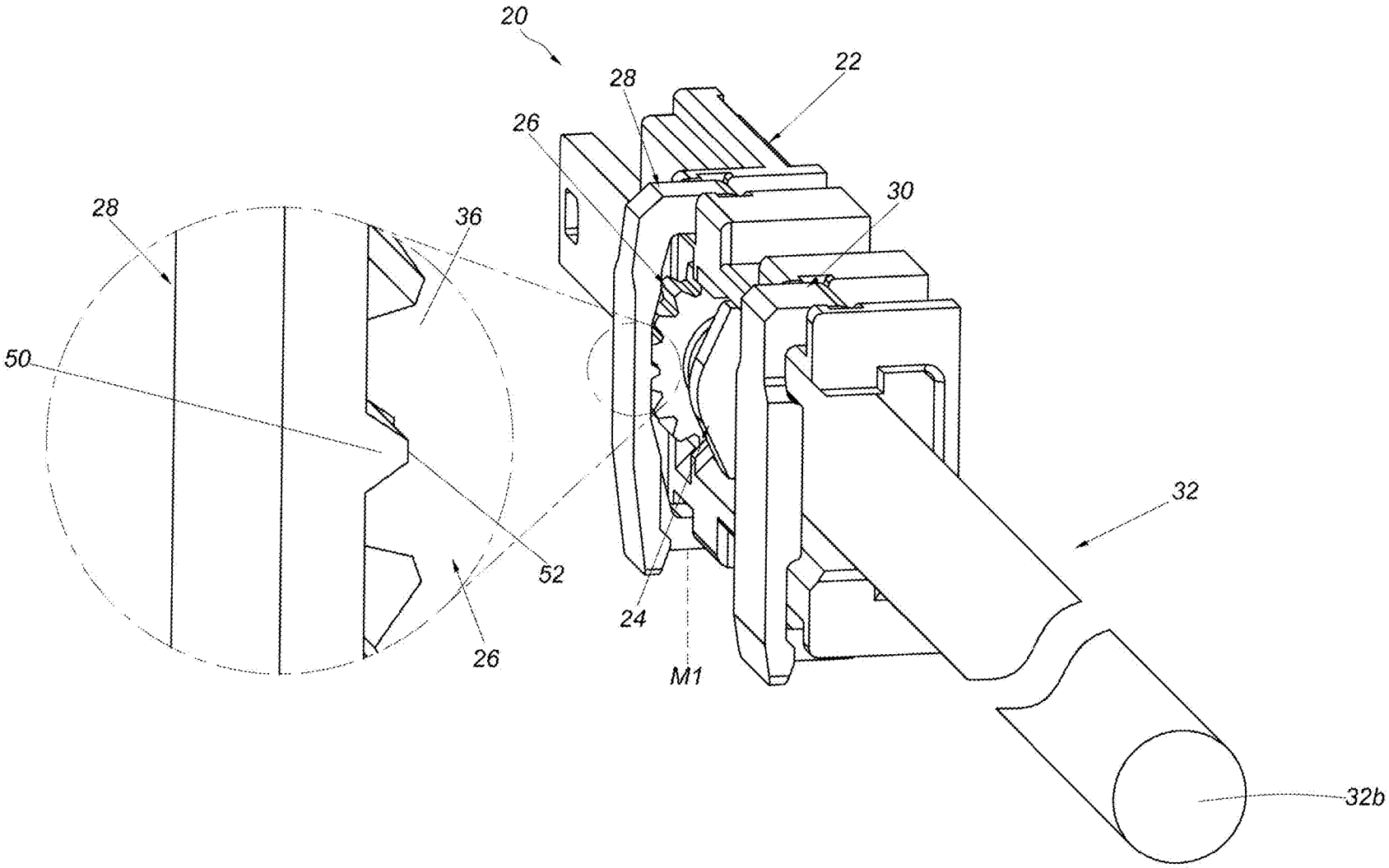
FIG. 6 is a diagram of the adjusting device as an engaging member is in an engaging state according to the embodiment of the present invention.

As shown in FIG. 6, the engaging member 28 includes an engaging section 50. When the engaging member 28 is in the engaging state M1 relative to the base 22, the engaging section 50 of the engaging member 28 is configured to engage with a corresponding section 52 of the adjusting member 26 for preventing the adjusting member 26 from adjusting the driving member 24 and the working member 32. In this embodiment, by way of example, the engaging section 50 can be a protruding structure, and the corresponding section 50 can be a recessed structure configured to cooperate with the protruding structure. However, the present invention is not limited to this embodiment.

Figure 7:
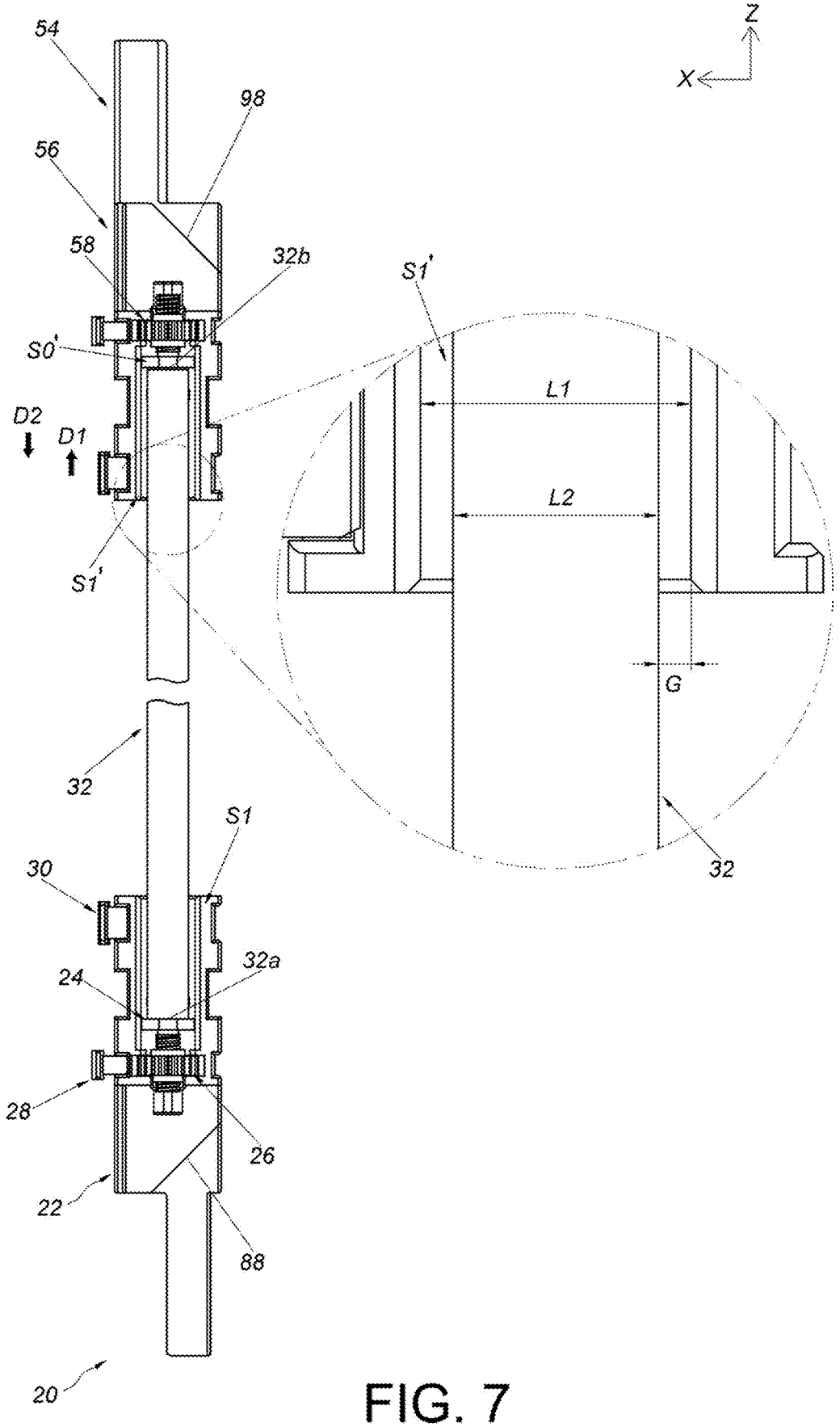
FIG. 7 is a diagram illustrating the working member is adjusted by the adjusting device and an auxiliary device cooperatively according to the embodiment of the present invention.

In the embodiment of FIG. 7, the adjusting device 20 is configured to cooperate with an auxiliary device 54 for adjusting the working member 32. The auxiliary device 54 and the adjusting device 20 can have similar structures. Specifically, an auxiliary base 56 of the auxiliary device 54 and the base 22 of the adjusting device 20 can have substantially symmetrical structures, and a symmetry axis of the base 22 of the adjusting device 20 and the auxiliary base 56 of the auxiliary device 54 is oriented along a direction perpendicular to the height direction and parallel to the longitudinal direction. However, the present invention is not limited to this embodiment. For example, in another embodiment, the working member is configured to be adjusted by the adjusting device only.

The working member 32 is arranged between the adjusting device 20 and the auxiliary device 54. Furthermore, the first end portion 32*a* of the working member 32 is connected to the adjusting device 20, and a second end portion 32*b* of the working member 32, which is opposite to the first end portion 32*a* of the working member 32, is inserted into a first auxiliary receiving portion S1' of an auxiliary receiving structure S0' of the auxiliary base 56 of the auxiliary device 54 along the height direction parallel to the Z axis. For example, the first end portion 32*a* and the second end portion 32*b* of the working member 32 are an upper end portion and a lower end portion of the working member 32, respectively. The operational principle of the auxiliary device 54 is substantially identical to the operational principle of the adjusting device 20. Detailed description for the auxiliary device 54 is omitted herein for simplicity. The configuration of the adjusting device 20 and the auxiliary device 54 enables the user to adjust the working member 32 to move along the first direction D1 or the second direction D2 by adjusting the adjusting member 26 of the adjusting device 20 adjacent to the first end portion 32*a* of the working member 32, or by adjusting an auxiliary member 58 of the auxiliary device 54 adjacent to the second end portion 32*b* of the working member 32, which brings convenience in use.

It should be noticed that a dimension of the first receiving portion S1 of the base 22 of the adjusting device 20 along the longitudinal direction, which is perpendicular to the height direction and parallel to the X axis, is greater than a dimension of the first end portion 32*a* of the working member 32 relative to the base 22 of the adjusting device 20 along the longitudinal direction for allowing the working member 32 to move along the longitudinal direction within a limited range, and a dimension of the first auxiliary receiving portion S1' of the auxiliary base 56 of the auxiliary device 54 along the longitudinal direction is greater than a dimension of the second end portion 32*b* of the working member 32 along the longitudinal direction for allowing the working member 32 to move relative to the auxiliary base 56 of the auxiliary device 54 along the longitudinal direction within a limited range. The dimensional configuration of the first receiving portion S1 of the base 22 of the adjusting device 20 and the first end portion 32*a* of the working member 32 is the same as the dimensional configuration of the first auxiliary receiving portion S1' of the auxiliary base 56 of the auxiliary device 54 and the second end portion 32*b* of the working member 32. Detailed description for the dimensional configuration of the first auxiliary receiving portion S1' of the auxiliary base 56 of the auxiliary device 54 and the second end portion 32*b* of the working member 32 is provided for simplicity. As shown in FIG. 7, the first auxiliary receiving portion S1' and the second end portion 32*b* of the working member 32 are designed to have a first longitudinal dimension L1 and a second longitudinal dimension L2 less than the first longitudinal dimension L1, respectively, such that the a longitudinal gap G is formed between the auxiliary base 56 of the auxiliary device 54 and the second end portion 32*a* of the working member 32 for allowing the working member 32 to move relative to the auxiliary base 56 of the auxiliary device 54 along the longitudinal direction within the limited range.

Figure 8:
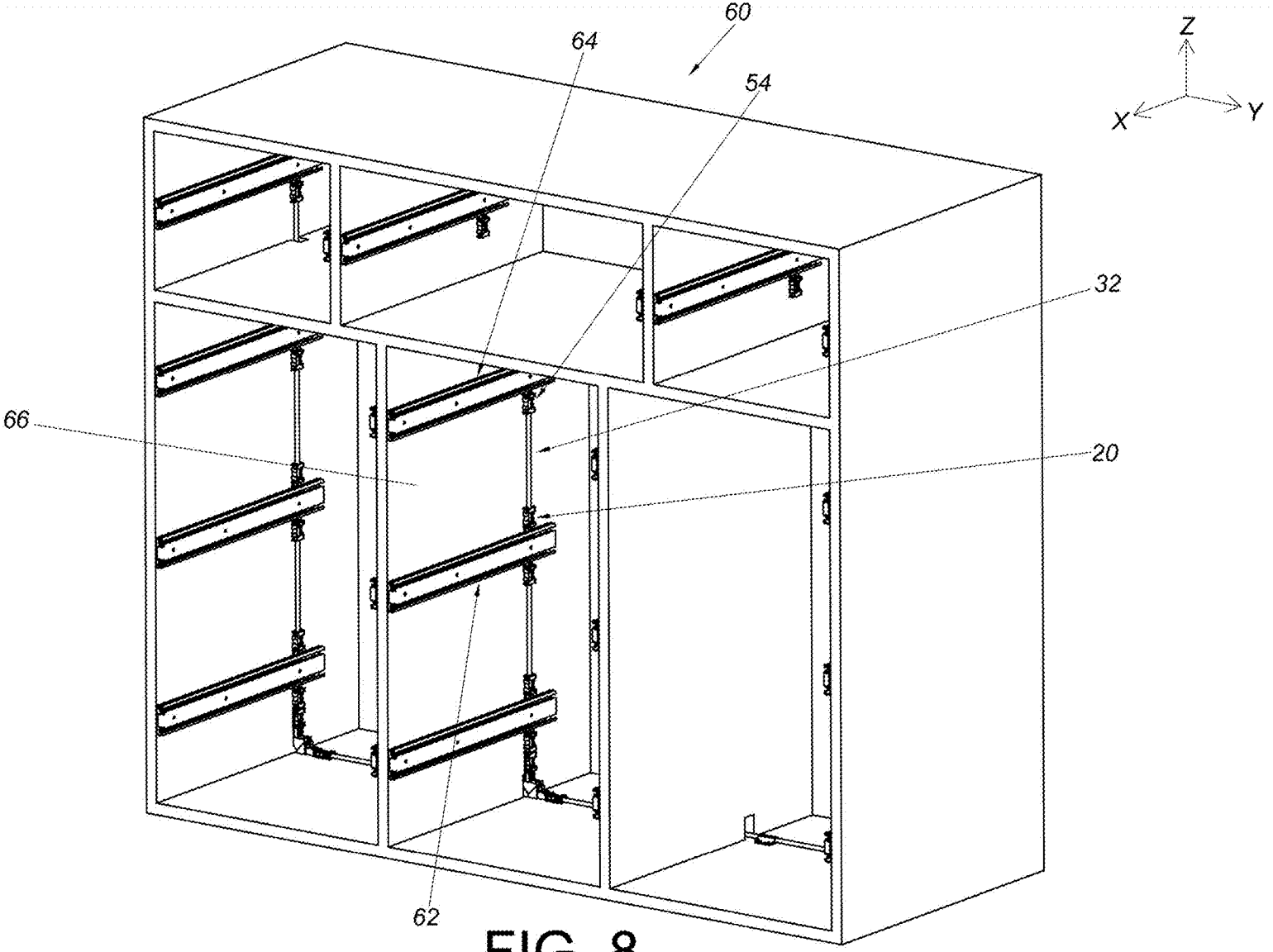
FIG. 8 is a diagram of a slide rail mechanism adapted for a cabinet according to the embodiment of the present invention.

As shown in FIG. 8, a slide rail mechanism including a plurality of slide rail assemblies, e.g., a first slide rail assembly 62 and a second slide rail assembly 64, is adapted for a cabinet 60, so as to support a plurality of carried objects, e.g., a plurality of drawers, which are not shown in the figures.

Furthermore, the first slide rail assembly 62 and the second slide rail assembly 64 can be arranged on a predetermined wall 66 of the cabinet 60 and located at different heights. The first slide rail assembly 62 and the second slide rail assembly 64 can have substantially identical structures and arranged on the cabinet 60 in the substantially same manner.

Preferably, the adjusting device 20, the working member 32 and the auxiliary device 54 can cooperatively form an interlock between the first slide rail assembly 62 and the second slide rail assembly 64, so as to prevent both the first slide rail assembly 62 and the second slide rail assembly 64 from being opened simultaneously.

Figure 9:
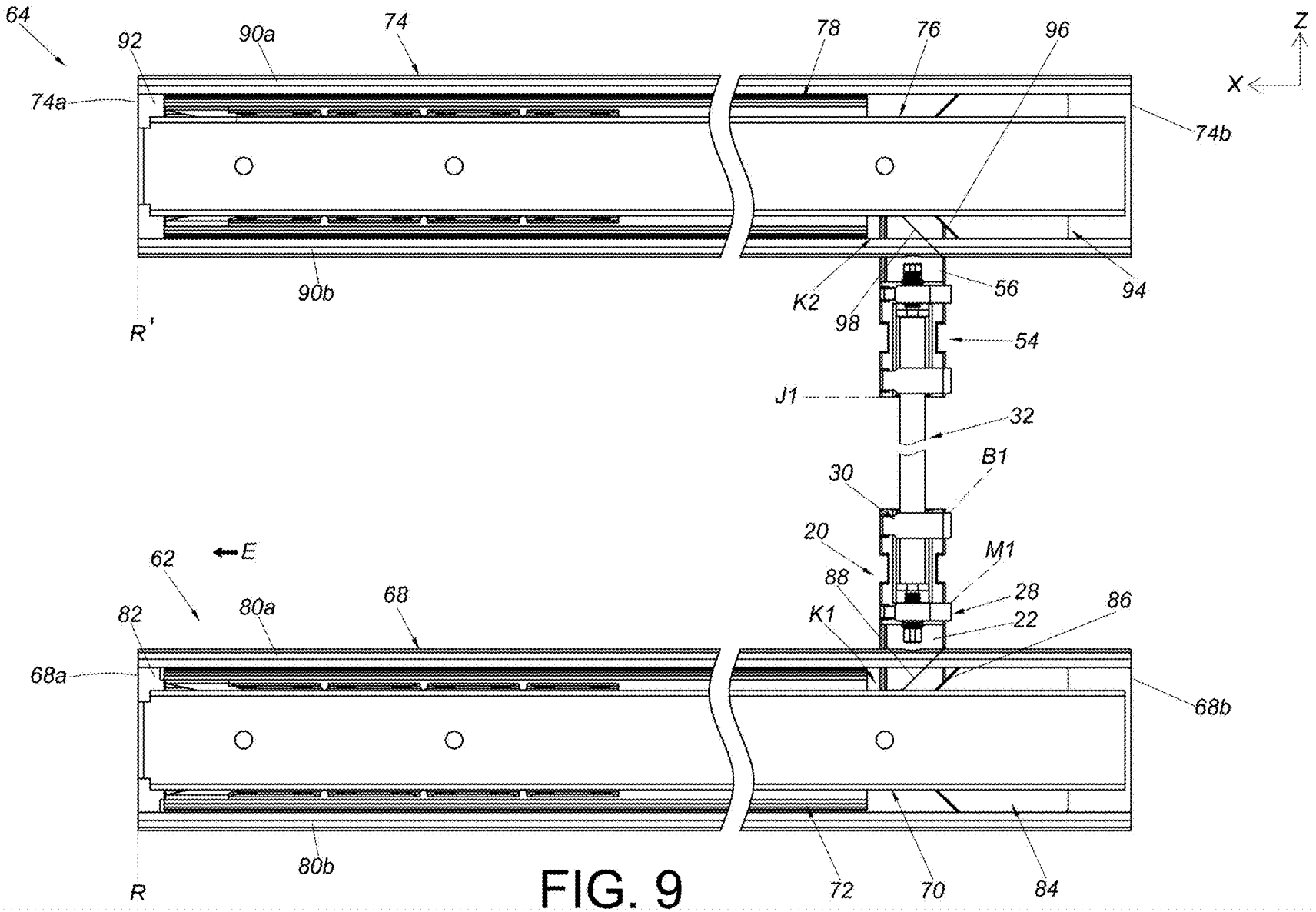
FIG. 9 is a diagram of the slide rail mechanism as each of a first slide assembly and a second slide assembly is in a retracted state according to the embodiment of the present invention.

As shown in FIG. 9, the slide rail mechanism includes the first slide rail assembly 62, the second slide rail assembly 64, the adjusting device 20, the working member 32 and the auxiliary device 54.

The first slide rail assembly 62 includes a first rail 68 and a second rail 70 displaceable relative to the first rail 68 along the longitudinal direction. Preferably, the first slide rail assembly 62 further includes a first middle rail 72 movably mounted between the first rail 68 and the second rail 70. The second slide rail assembly 64 includes a third rail 74 and a fourth rail 76 displaceable relative to the third rail 74 along the longitudinal direction. Preferably, the second slide rail assembly 64 further includes a second middle rail 78 movably mounted between the third rail 74 and the fourth rail 76. The first rail 68 of the first slide rail assembly 62 and the third rail 74 of the second slide rail assembly 64 are configured to be mounted, e.g., fixed, onto the predetermined wall 66 of the cabinet 60. The second rail 70 of the first slide rail assembly 62 and the fourth rail 76 of the second slide rail assembly 64 are configured to support a first carried object, e.g., a first drawer, and a second carried object, e.g., a second drawer, respectively.

The adjusting device 20 is movably mounted on the first slide rail assembly 62. For example, the first rail 68 includes a first wall 80*a*, a second wall 80*b* and a longitudinal wall 82 connected between the first wall 80*a* and the second wall 80*b* of the first rail 68. The first rail 68 has a first end 68*a* and a second end 68*b*. In this embodiment, by way of example, the first end 68*a* and the second end 68*b* of the first rail 68 are a front end and a rear end of the first rail 68, respectively. However, the present invention is not limited to this embodiment. The first rail 68 further includes a first accommodating structure K1 for mounting the adjusting device 20. In this embodiment, by way of example, the first accommodating structure K1 includes two accommodating portions communicated with each other and arranged on the first wall 80*a* and the longitudinal wall 82 of the first rail 68, respectively. Preferably, the first slide rail assembly 62 further includes a first predetermined member 84 configured to be driven by the second rail 70 to move along an opening direction E. One of the first predetermined member 84 and the adjusting device 20 includes a guiding feature, e.g., an inclined surface or an arc surface. In this embodiment, by way of example, the first predetermined member 84 includes a first guiding feature 86, and the base 22 of the adjusting device 20 includes a second guiding feature 88. However, the present invention is not limited to this embodiment.

The auxiliary device 54 is movably mounted on the second slide rail assembly 64. For example, the third rail 74 includes a first wall 90*a*, a second wall 90*b* and a longitudinal wall 92 connected between the first wall 90*a* and the second wall 90*b* of the third rail 74. The third rail 74 has a first end 74*a* and a second end 74*b*. In this embodiment, by way of example, the first end 74*a* and the second end 74*b* of the third rail 74 are a front end and a rear end of the third rail 74, respectively. However, the present invention is not limited to this embodiment. The third rail 74 further includes a second accommodating structure K2 for mounting the auxiliary device 54. In this embodiment, by way of example, the second accommodating structure K2 includes two accommodating portions communicated with each other and arranged on the second wall 90*b* and the longitudinal wall 92 of the third rail 74, respectively. Preferably, the second slide rail assembly 64 further includes a second predetermined member 94 configured to be driven by the fourth rail 76 to move along the opening direction E. One of the second predetermined member 94 and the auxiliary device 54 includes a guiding feature, e.g., an inclined surface or an arc surface. In this embodiment, by way of example, the second predetermined member 94 includes a third guiding feature 96, and the auxiliary base 56 of the auxiliary device 54 includes a fourth guiding feature 98. However, the present invention is not limited to this embodiment.

The working member 32 is arranged between the adjusting device 20 and the auxiliary device 54.

It should be noticed that, in an ideal scenario, when the first slide rail assembly 62 and the second slide rail assembly 64 are arranged on the predetermined wall 66 of the cabinet 60, two end portions of the first slide rail assembly 62, e.g., a front end portion and a rear end portion of the first slide rail assembly 62, are respectively aligned with two end portions of the second slide rail assembly 64, e.g., a front end portion and a rear end portion of the second slide rail assembly 64, along the height direction parallel to the Z axis. For example, the first end 68*a* of the first rail 68 of the first slide rail assembly 62 is aligned with the first end 74*a* of the third rail 74 of the second rail assembly 64 along the height direction.

As shown in FIG. 9, when each of the first slide rail assembly 62 and the second slide rail assembly 64 is in a retracted state, the interlock is at a first position J1. Furthermore, when the second rail 70 is located at a retracted position R relative to the first rail 68 and the fourth rail 76 is located at a retracted position R' relative to the third rail 74, the interlock is at the first position J1.

Figure 10:
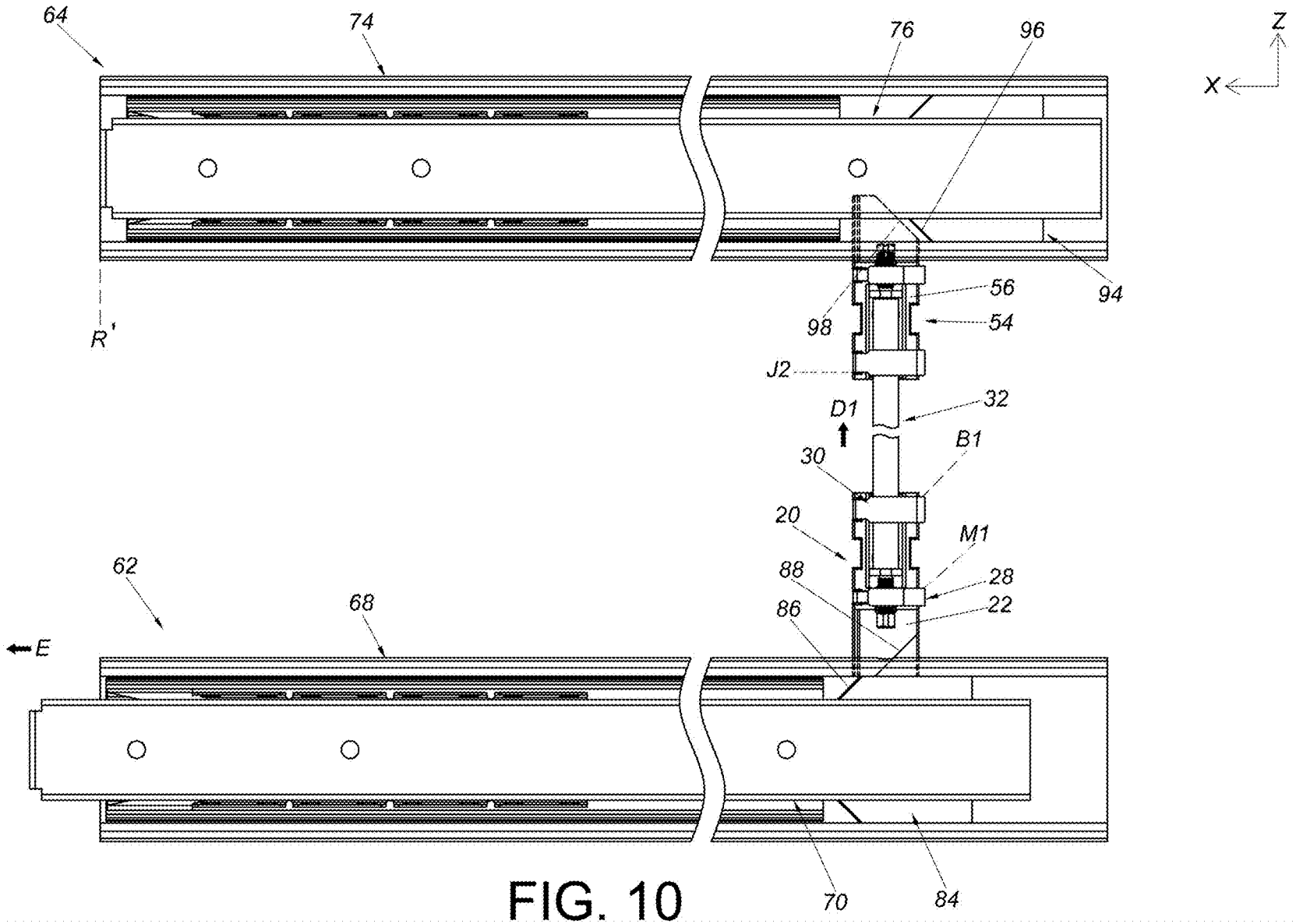
FIG. 10 is a diagram of the slide rail mechanism as the first slide assembly is locked in the retracted state according to the embodiment of the present invention.

As shown in FIG. 9 and FIG. 10, when the second rail 70 displaces relative to the first rail 68 from the retracted position R along the opening direction E, the adjusting device 20, the working member 32 and the auxiliary device 54 are driven to move, such that the fourth rail 57 is prevented by the auxiliary device 54 from displacing relative to the third rail 74 from the retracted position R' along the opening direction E.

Specifically, when the second rail 70 displaces relative to the first rail 68 from the retracted position R along the opening direction E and the second slide rail assembly 64 is in the retracted state, the first predetermined member 84 and the adjusting device 20 can abut against each other, e.g., by the first guiding feature 86 of the first predetermined member 84 and the second guiding feature 88 of the adjusting device 20, to drive the adjusting device 20, the working member 32 and the auxiliary device 54 for driving the interlock from the first position J1 as shown in FIG. 9 to a second position J2 as shown in FIG. 10 along the first direction D1. When the interlock is at the second position J2, the auxiliary device 54 and the second predetermined member 94 can block each other, e.g., by the fourth guiding feature 98 of the auxiliary device 54 and the third guiding feature 96 of the second predetermined member 94, for preventing the fourth rail 76 from displacing relative to the third rail 74 from the retracted position R' along the opening direction E.

Preferably, the first predetermined member 84 can support the adjusting device 20 for retaining the interlock at the second position J2 as shown in FIG. 10, so as to keep the fourth guiding feature 98 of the auxiliary device 54 blocking the third guiding feature 96 of the second predetermined member 94.

It should be noticed that, in order to prevent malfunction of the interlock caused by, e.g., an assembly error of the working member 32, the first slide rail assembly 62 and/or the second slide rail assembly 64 in the height direction, the adjusting device 20 and/or the auxiliary device 54 can be used to adjust the working member 32 to compensate the assembly error in the height direction. Besides, when the engaging member 28 of the adjusting device 20 is in the engaging state M1, the engaging member 28 is configured to engage with the adjusting member 26 for preventing the adjusting member 26 from adjusting the driving member 24 and the working member 32. In addition, the blocking member 30 can be operated to the blocking state B1 to block the transversal opening O for preventing the working member 32 from departing from the first receiving portion S1 of the base 22 of the adjusting device 20 and the first auxiliary receiving portion S1' of the auxiliary base 56 of the auxiliary device 54 along the transverse direction parallel to the Y axis.

On the other hand, when the first slide rail assembly 62 is in the retracted state and the fourth rail 76 displaces relative to the third rail 74 from the retracted position R' along the opening direction E, the second predetermined member 94 can press the auxiliary device 54 to retain the interlock at the first position J1 to keep the second guiding feature 88 of the adjusting device 20 blocking the first predetermined member 84 of the first slide rail assembly 62 for preventing the second rail 70 from displacing relative to the first rail 68 from the retracted position R along the opening direction.

Figure 11:
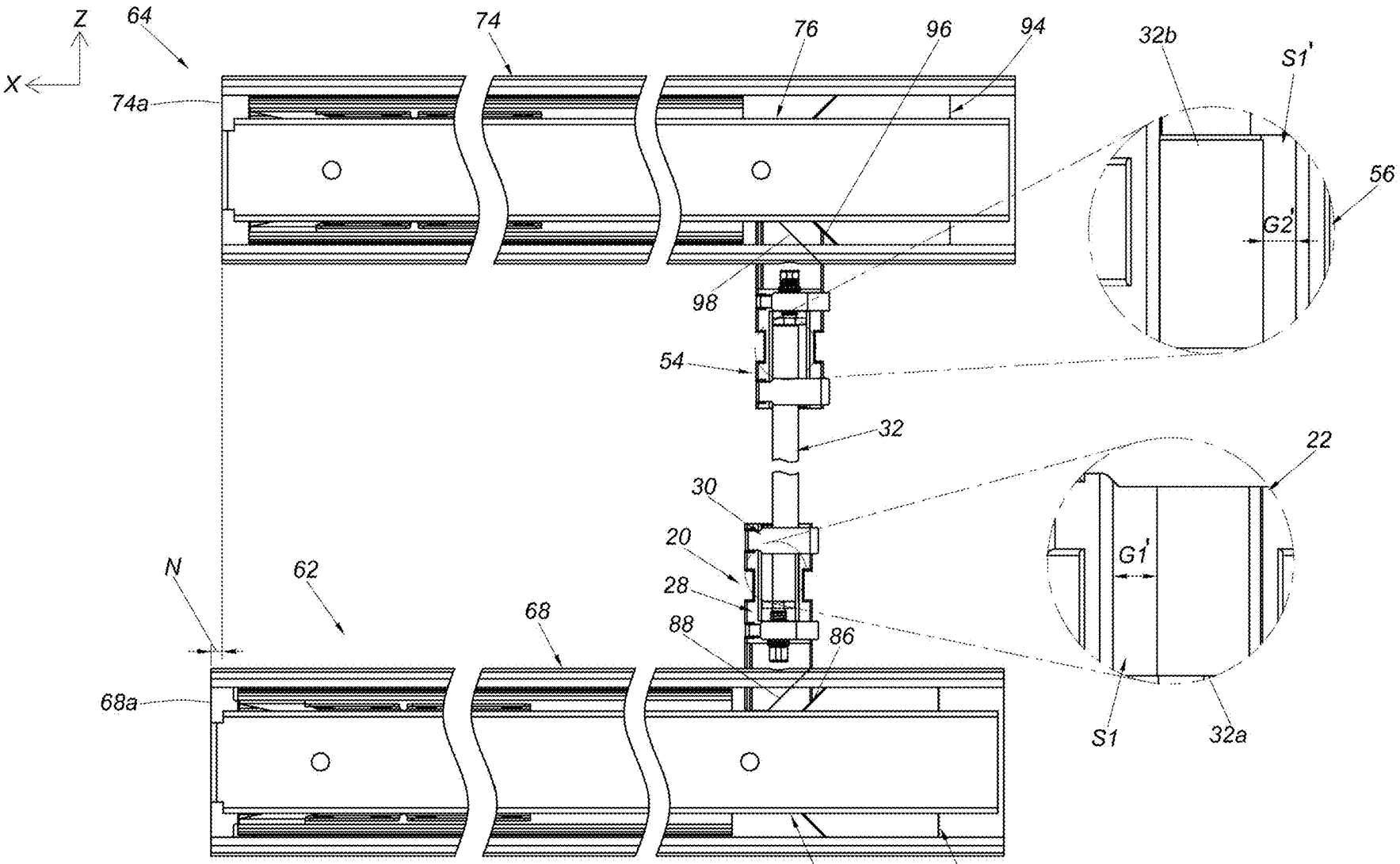
FIG. 11 is a diagram of the slide rail mechanism as there is assembly error between the first slide assembly and the second slide rail assembly according to the embodiment of the present invention.

As shown in FIG. 11, in a non-ideal scenario, when the first slide rail assembly 62 and the second slide rail assembly 64 are arranged on the predetermined wall 66 of the cabinet 60, the two end portions of the first slide rail assembly 62, e.g., the front end portion and the rear end portion of the first slide rail assembly 62, are respectively misaligned from the two end portions of the second slide rail assembly 64, e.g., the front end portion and the rear end portion of the second slide rail assembly 64, along the height direction parallel to the Z axis, due to an assembly error. For example, the first end 68*a* of the first rail 68 of the first slide rail assembly 62 is misaligned from the first end 74*a* of the third rail 74 of the second rail assembly 64 along the height direction by an offset N, e.g., due to an assembly error of the first slide rail assembly 62 and/or the second slide rail assembly 64 in the longitudinal direction.

Since the dimension of the first receiving portion S1 of the base 22 of the adjusting device 20 along the longitudinal direction parallel to the X axis is greater than the dimension of the first end portion 32*a* of the working member 32 relative to the base 22 of the adjusting device 20 along the longitudinal direction, a first longitudinal gap G1' is formed between the base 22 of the adjusting device 20 and the first end portion 32*a* of the working member 32. Since the dimension of the first auxiliary receiving portion S' of the auxiliary base 56 of the auxiliary device 54 along the longitudinal direction is greater than the dimension of the second end portion 32*b* of the working member 32 along the longitudinal direction, a second longitudinal gap G2' is formed between the auxiliary base 56 of the auxiliary device 54 and the second end portion 32*b* of the working member 32. Therefore, even if the first end 68*a* of the first rail 68 of the first slide rail assembly 62 is misaligned from the first end 74*a* of the third rail 74 of the second rail assembly 64 along the height direction by the offset N, the aforementioned dimensional configuration can compensate the assembly error in the longitudinal direction, i.e., the offset N between the first slide rail assembly 62 and the second slide rail assembly 64, for ensuring the interlock to move between the first position J1 and the second position J2 along the height direction properly. In other words, the present invention can compensate the assembly error for preventing malfunction of the interlock caused by the assembly error, which brings convenience in use.

From the above, the slide rail mechanism or the adjusting device 20 of the present invention includes the following characteristics:

1. The engaging member 28 is switchable relative to the base 22 between the engaging state M1 and the disengaging state M2. When the engaging member 28 is in the engaging state M1, the engaging member 28 is configured to engage with the adjusting member 26 for preventing the adjusting member 26 from adjusting the driving member 24 and the working member 32. When the engaging member 28 is in the disengaging state M2, the engaging member 28 disengages from the adjusting member 26 for allowing the adjusting member 26 to adjust the driving member 24 and the working member 32.
2. Since the dimension of the first receiving portion S1 of the base 22 of the adjusting device 20 along the longitudinal direction parallel to the X axis is greater than the dimension of the first end portion 32*a* of the working member 32 relative to the base 22 of the adjusting device 20 along the longitudinal direction, the first longitudinal gap G1' is formed between the base 22 of the adjusting device 20 and the first end portion 32*a* of the working member 32, so as to allow the first end portion 32*a* of the working member 32 to move within the limited range along the longitudinal direction for compensating the assembly error. For example, even if the first end 68*a* of the first rail 68 of the first slide rail assembly 62 is misaligned from the first end 74*a* of the third rail 74 of the second rail assembly 64 along the height direction by the offset N, the aforementioned dimensional configuration can compensate the assembly error in the longitudinal direction, i.e., the offset N between the first slide rail assembly 62 and the second slide rail assembly 64, for ensuring the interlock to move between the first position J1 and the second position J2 along the height direction properly, i.e., for preventing malfunction of the interlock caused by the offset N between the first slide rail assembly 62 and the second slide rail assembly 64.

3. The blocking member 30 is switchable between the blocking state B1 and the non-blocking state B2. The blocking member 30 can be operated to the blocking state B1 for preventing the working member 32 from departing from the base 22 of the adjusting device 20 and the auxiliary base 56 of the auxiliary device 54 along the transverse direction.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjusting device comprising:

a base;

a driving member;

an adjusting member arranged on the base and adjustably connected to the driving member; and an engaging member movably mounted on the base and switchable between an engaging state and a disengaging state relative to the base;

wherein when the engaging member is in the engaging state, the engaging member is configured to engage with the adjusting member for preventing the adjusting member from adjusting the driving member;

wherein when the engaging member is in the disengaging state, the engaging member disengages from the adjusting member for allowing the adjusting member to adjust the driving member.

2. The adjusting device of claim 1, wherein the adjusting member is configured to adjust the driving member by a rotation of the adjusting member, and the driving member is configured to move linearly relative to the base.

3. The adjusting device of claim 1, wherein the base comprises a receiving structure configured to at least partially receive the driving member and the adjusting member.

4. The adjusting device of claim 3, wherein the driving member is configured to drive a working member to move in response to a movement of the driving member.

5. The adjusting device of claim 4, wherein the receiving structure of the base of the adjusting device comprises a first receiving portion configured to receive a first end portion of the working member along a height direction.

6. The adjusting device of claim 5, wherein a dimension of the first receiving portion of the receiving structure of the base of the adjusting device along a longitudinal direction perpendicular to the height direction is greater than a dimension of the first end portion of the working member along the longitudinal direction for allowing the working member to move along the longitudinal direction within a limited range.

7. The adjusting device of claim 6, wherein the first receiving portion of the receiving structure of the base of the adjusting device comprises a transversal opening, the adjusting device further comprises a blocking member movably mounted on the base and switchable between a blocking state and a non-blocking state, and the blocking member is configured to block the transversal opening for preventing the working member from departing from the first receiving portion of the receiving structure of the base of the adjusting device along a transverse direction perpendicular to the height direction and the longitudinal direction via the transversal opening when the blocking member is in the blocking state.

8. The adjusting device of claim 7, wherein the first receiving portion of the receiving structure of the base of the adjusting device is configured to at least partially receive the driving member.

9. A slide rail mechanism comprising:

a first slide rail assembly comprising a first rail and a second rail displaceable relative to the first rail along a longitudinal direction;

a second slide rail assembly comprising a third rail and a fourth rail displaceable relative to the third rail along the longitudinal direction;

an adjusting device movably mounted on the first slide rail assembly;

an auxiliary device movably mounted on the second slide rail assembly; and a working member arranged between the adjusting device and the auxiliary device;

wherein when the second rail displaces relative to the first rail along an opening direction, the adjusting device, the working member and the auxiliary device are driven to move, such that the auxiliary device prevents the fourth rail from displacing relative to the third rail along the opening direction;

wherein the adjusting device comprises a base, an adjusting member and an engaging member, the adjusting member is arranged on the base and configured to adjust the working member, and the engaging member is switchable between an engaging state and a disengaging state relative to the base;

wherein when the engaging member is in the engaging state, the engaging member is configured to engage with the adjusting member for preventing the adjusting member from adjusting the driving member;

wherein when the engaging member is in the disengaging state, the engaging member disengages from the adjusting member for allowing the adjusting member to adjust the driving member.

10. The slide rail mechanism of claim 9, wherein the auxiliary device comprises an auxiliary base, the base of the adjusting device and the auxiliary base of the auxiliary device have symmetrical structures, the base of the adjusting device comprises a receiving structure, the auxiliary base of the auxiliary device comprises an auxiliary receiving structure, the working member comprises a first end portion and a second end portion opposite to the first end portion, the first end portion and the second end portion of the working member are respectively inserted into a first receiving portion of the receiving structure of the base of the adjusting device and a first auxiliary receiving portion of the auxiliary receiving structure of the auxiliary base of the auxiliary device along a height direction, and a symmetry axis of the base of the adjusting device and the auxiliary base of the auxiliary device is oriented along a direction perpendicular to the height direction.

11. The slide rail mechanism of claim 10, wherein a dimension of the first receiving portion of the receiving structure of the base of the adjusting device along a longitudinal direction perpendicular to the height direction is greater than a dimension of the first end portion of the working member along the longitudinal direction, and a dimension of the first auxiliary receiving portion of the auxiliary receiving structure of the auxiliary base of the auxiliary device along the longitudinal direction is greater than a dimension of the second end portion of the working member along the longitudinal direction.

12. The slide rail mechanism of claim 11, wherein each of the first receiving portion of the receiving structure of the base of the adjusting device and the first auxiliary receiving portion of the auxiliary receiving structure of the auxiliary base of the auxiliary device comprises a transversal opening, and the adjusting device further comprises a blocking member configured to block the transversal opening of the first receiving portion of the receiving structure of the base of the adjusting device for preventing the working member from departing from the first receiving portion of the receiving structure of the base of the adjusting device along a transverse direction perpendicular to the height direction and the longitudinal direction via the transversal opening of the first receiving portion of the receiving structure of the base of the adjusting device.

13. The slide rail mechanism of claim 12, wherein the adjusting device further comprises a driving member arranged on the base and connected to the adjusting member in a screwing manner, and the adjusting member is configured to adjust the driving member to move linearly by a rotation of the adjusting member, so as to drive the working member in response to a movement of the driving member.

14. The slide rail mechanism of claim 13, wherein the receiving structure of the base of the adjusting device further comprises a second receiving portion communicated with the first receiving portion, the first receiving portion is configured to at least partially receive the driving member and the working member, and the second receiving portion is configured to at least partially receive the adjusting member.

15. An adjusting device comprising:

a base;

a driving member; and an adjusting member arranged on the base and adjustably connected to the driving member;

wherein the base of the adjusting device comprises a receiving structure configured to at least partially receive the driving member and the adjusting member;

wherein the driving member is configured to drive a working member to move in response to a movement of the driving member;

wherein the receiving structure of the base of the adjusting device comprises a first receiving portion configured to receive a first end portion of the working member along a height direction;

wherein a dimension of the first receiving portion of the receiving structure of the base of the adjusting device along a longitudinal direction perpendicular to the height direction is greater than a dimension of the first end portion of the working member along the longitudinal direction for allowing the working member to move along the longitudinal direction within a limited range;

wherein the first receiving portion of the receiving structure of the base of the adjusting device comprises a transversal opening, the adjusting device further comprises a blocking member movably mounted on the base, and the blocking member is configured to block the transversal opening for preventing the working member from departing from the first receiving portion of the receiving structure of the base of the adjusting device along a transverse direction perpendicular to the height direction and the longitudinal direction when the blocking member is in a blocking state.

16. The adjusting device of claim 15, wherein the first receiving portion of the receiving structure of the base of the adjusting device is configured to at least partially receive the driving member.

17. The adjusting device of claim 15, further comprising an engaging member switchable between an engaging state and a disengaging state relative to the base, when the engaging member is in the engaging state, the engaging member being configured to engage with the adjusting member for preventing the adjusting member from adjusting the driving member, and when the engaging member is in the disengaging state, the engaging member disengaging from the adjusting member for allowing the adjusting member to adjust the driving member.

18. The adjusting device of claim 17, wherein the engaging member is movably mounted on the base, the adjusting member is configured to adjust the driving member by a rotation of the adjusting member, the driving member is configured to move linearly relative to the base, and the adjusting member is connected to the driving member in a screwing manner.

* * * * *